United States Patent [19]

Dätwyler

[11] 4,437,942

[45] Mar. 20, 1984

[54] METHODS FOR PRODUCING PRINTING PLATES, AND PRINTING PLATES PRODUCED THEREBY

[75] Inventor: Max Dätwyler, Langenthal, Switzerland

[73] Assignee: MDC Max Dätwyler AG, Bleienbach, Switzerland

[21] Appl. No.: 337,561

[22] Filed: Jan. 6, 1982

Related U.S. Application Data

[63] Continuation-in-part of Ser. No. 279,383, Jul. 1, 1981, abandoned.

[30] Foreign Application Priority Data

Jul. 10, 1980 [CH] Switzerland ..... 5290/80

[51] Int. Cl.[3] ..... C25D 1/20; C25D 5/00

[52] U.S. Cl. ..... 204/6; 204/17

[58] Field of Search ..... 204/6, 17

[56] References Cited

U.S. PATENT DOCUMENTS

| | | | |
|---|---|---|---|
| 218,473 | 8/1879 | Barrie | 204/6 |
| 1,171,819 | 2/1916 | Warren | 204/6 |
| 1,394,085 | 10/1921 | Halvorson | 204/7 |
| 3,091,578 | 5/1963 | Hetherington | 204/16 |
| 3,403,082 | 9/1968 | Blackmore | 204/6 |

*Primary Examiner*—T. M. Tufariello

*Attorney, Agent, or Firm*—Benoit Law Corporation

[57] ABSTRACT

A wrap-on printing plate with first and second clamping bars along opposite sides thereof for installation on a printing cylinder is produced by providing a layer defining a printing plate body, forming from marginal portions of that layer, along opposite sides thereof, first and second foundations for the first and second clamping bars, respectively. These clamping bars are provided on such first and second foundations by interatomic bonding between the first and second foundations and the first and second clamping bars, respectively. To this end, the layer may, for instance, be electroplated on existing clamping bars in a special form, or, as presently preferred, material from which the first and second clamping bars are formed may be electroplated on the first and second foundations formed in marginal portions of the mentioned layer.

62 Claims, 7 Drawing Figures

METHODS FOR PRODUCING PRINTING PLATES, AND PRINTING PLATES PRODUCED THEREBY

CROSS-REFERENCE

This is a continuation-in-part of U.S. patent application Ser. No. 06/279,383, filed by the subject inventor on July 1, 1981, now abandoned, for Methods and Apparatus for Producing Printing Plates, and Printing Plates Produced Thereby, assigned to the assignee of the subject patent application.

BACKGROUND OF THE INVENTION

1. Field of the Invention

The subject invention relates to printing equipment and, more specifically, to wrap-on printing plates and to methods and apparatus for producing same.

2. Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness, and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

Rotogravure printing is becoming increasingly preferred over offset printing where fine printing quality is important, especially for long printing runs. Rotogravure printing also turns out to be more economical than offset printing, when high quality is to be maintained throughout extremely long runs.

However, unlike offset printing, rotogravure printing has lacked flexibility. In this respect, recent years have seen an increasing demand for items of regional interest and for local advertisements in national newspapers and periodicals. This demand has been paralleled by an increasing need for effective language or text changes, or listings of such items as prices and firm names, in larger, otherwise unaltered catalogs or other texts. These and other changes in copy, page insertions and regional advertisements are costly to the gravure printer in production time and expense.

A solution to this problem has been seen in providing a rotogravure system with exchangeable printing plates which may be wrapped onto the printing cylinder so as to permit localized changes to be effected thereon without replacement of an entire printing cylinder. The term "wrap-on" is employed herein generically, to extend at least to wrap-around plate systems and to systems in which the plate is only wrapped on part of the circumference of the cylinder.

In this respect, wrap-on blankets have been known for a long time in offset printing. However, such blankets, as well as similar approaches, were not suitable since they inherently left large gaps where the blanket or similar structure was attached to the printing cylinder, as may, for instance, be seen from U.S. Pat. Nos. 1,074,775, by G. R. Cornwall, issued Oct. 7, 1913, for an offset blanket, 1,275,877, by C. E. Drange, issued Aug. 13, 1918, for a plate printing machine, 1,565,216, by C. N. Smith, issued Dec. 8, 1925, for an electroplated stero-type plate, 1,750,562, by P. Allman, issued Mar. 11, 1930, for a printing surface, 2,108,822, by W. L. Lippincott, issued Feb. 22, 1938, for a printing plate and formation thereof, 2,305,852, by H. N. Durham, issued Dec. 22, 1942 for a stereo-type printing plate, 2,953,091, by H. J. Luehrs, issued Sept. 20, 1960, for plate clamping means for wraparound printing plates, 3,230,883, by M. Achinger et al, issued Jan. 25, 1966, for a printing press plate clamping mechanism, 4,178,402, by F. Klapproth, issued Dec. 11, 1979, for a cylinder blanket for offset printing presses, and 4,227,459, by W. Jeschke, issued Oct. 14, 1980, for a transfer drum for rotary printing presses, and French Pat. Nos. 553.002, by Société Anonyme des Anciens Établissements Marinoni et Voirin Réunis, issued Feb. 1, 1923, for devices for installing plates on rotary printing cylinders and 1.044.012, by Marinoni S. A., issued June 17, 1953, for rotary printing plate tensioning mechanisms.

There also is a line of proposals which uses part of the printing plate itself for tensioning purposes as may, for instance, be seen from U.S. Pat. Nos. 2,131,891, by W. F. Huck, issued Oct. 4, 1938, for a printing plate having spaced apertures or recesses for engagement by locking fingers 2,630,756, by J. O. Crabtree et al, issued Mar. 10, 1953, for printing plates having projections and recesses for engagement by retention devices, 3,029,730, by J. R. Parrish et al, issued Apr. 17, 1962, for a method of forming laminated printing plates with plastic cores having grooves for cooperation with securing clamps, 3,490,369, by W. F. Huck, issued Jan. 20, 1970, for a printing cylinder and plate securing interlocking system, and 3,976,005, by H. Kaufmann, issued Aug. 24, 1976, for a printing plate having indentations for plate securing purposes, and German Published Patent Application Auslegeschrift No. 1 092 035, by L. Horn, published Nov. 3, 1960, and disclosing a tensioning mechanism for stereo-type plates in which locking fingers engage corresponding recesses in the printing plates. By way of general comment, proposals of the type shown in these references would be restricted to plates of considerable thickness.

Similar considerations apply to proposals in which a bent portion of the printing plate itself is grabbed for tensioning and retention thereof on a printing cylinder, as may, for instance, be seen from U.S. Pat. Nos. 2,775,198, by T. H. Johnson et al, issued Dec. 25, 1956, for a plate clamp, and 4,214,530, by J. A. Signorelli et al, issued July 29, 1980, for a metal printing plate, French Pat. No. 1.115.946, by A. Cuny, issued Jan. 23, 1956, for printing plates tensioning devices, and German Pat. No. 617 936, by Schnellpressenfabrik Koenig & Bauer A. G., issued Feb. 6, 1934, for a mechanism for tensioning flexible printing plates on a form cylinder.

A series of proposals for attaching a wrap-around printing plate to a printing cylinder with the aid of folded over margins of the printing plate is apparent from U.S. Pat. No. 1,049,195, by W. H. Banzett, issued Dec. 31, 1912. The very complex clamping apparatus for tensioning locked printing plates disclosed in U.S. Pat. No. 2,474,127, by P. L. Tollison et al, issued June 21, 1949, appears to fall into the same category.

Bending off the ends of a printing plate sharply and pulling them inwardly into the printing cylinder in practice leaves gaps which have to be filled in some manner in order to avoid strong visible gap marks on the printed work. Reference may in this respect be had to U.S. Pat. No. 1,795,700, by G. T. Baldwin, issued Mar. 10, 1931, for a mechanism for securing flexible plates to printing cylinders, to its corresponding Italian Pat. No. 296 395, issued Mar. 16, 1932, to U.S. Pat. No. 1,996,348, by L. T. A. Robinson, issued Apr. 2, 1935, for a complex multi-segment print cylinder arrangement with wrap-on printing plate, to its corresponding German Pat. No. 567 546, issued Feb. 21, 1931, to British Patent Specification No. 840,586, by F. H. Levey Company, Inc., published July 6, 1960, and disclosing clamping devices for printing presses employing sharply downturned printing plate margins, and Swiss Pat. No. 146 573, by Vogtländische Maschinen-Fabrik A. G., issued Apr. 30, 1931, for a form cylinder for rubber printing machines in which the margins of the printing plate are also turned inwardly at an acute angle and a bar has to be employed in an attempt to close the gap between the outward printing plate end portions. These and other proposed methods for closing printing plate gaps are, however, either practically ineffective or cumbersome and time consuming, just like the casting of the plate butt, shown in German Patent Publication Offenlegungsschrift No. 24 09 456, by H. Kurtz, published Aug. 28, 1975, for rotary printing cylinders, and the abstract of German Utility Model Registration No. 75 25 069.

German Pat. No. 541 478, by Mashinenfabrik Johannisberg G.m.b.H., issued Dec. 30, 1930, shows a device for clamping flexible printing plates on the form cylinder of intaglio printing presses where the bent-off ends of the printing plates are held in clamping strips and stressed by means of a wedge both in radial and in tangential directions. This device is only suitable for form cylinders which have the width of the printing plates, and it has a disadvantage that the form cylinder must be removed from the machine to change the printing plates, since the clamping strips and the wedge can only be introduced into the dove-tailed grooves at the front end.

A proposal which is even more impractical for present purposes is apparent from U.S. Pat. No. 1,807,637, by E. Sachs, issued June 2, 1931, and proposing the provision of a helical dove-tailed groove over the circumferential surface of a printing cylinder of aluminum or another light metal. A strap, ribbon or wire of copper or other well-conducting metal, is forced into that groove to become wedged therein and to extend therealong also in a helical fashion. A metal layer serving as the etching ground is then placed upon the surface of the light metal cylinder. Such metal layer, which may, for instance, be a copper coating, thereby is supposed to be firmly connected with the helical metal strap, ribbon or wire. Of course, if such a procedure were followed for present purposes, the metal layer or printing plate could not be removed from the light metal printing cylinder, but would be permanently affixed thereto, which would defeat the object of interchangeability of printing plates relative to a printing cylinder. In that respect, the latter Sachs proposal follows in effect the teaching of U.S. Pat. No. 789,342, by F. A. Voelke, issued May 9, 1905, for a process of construction seamless, hollow articles in which a seamless spherical or hollow-cylindrical shell is permanently and irremovably plated on internal bracing plates.

In this respect, reference may also be had to U.S. Pat. No. 3,359,898, by F. L. Baier et al, issued Dec. 26, 1967, for process of preparing electro-type printing plates, U.S. Pat. No. 3,676,040 by P. W. McKinney, issued July 11, 1972, for apparatus for producing trimmed printing face plates, U.S. Published patent application No. B 462,424, by L. C. McCandless, published Feb. 24, 1976 and disclosing a method of making reinforced composite structures employing electroforming technology, British Patent Specification No. 694,141, by O. Evans, published July 15, 1953, and disclosing an electrotyper's case for the electrodeposition of curved shells, and British Patent Specification No. 1 537 243, by A. O. Jakubovich et al, published Dec. 29, 1978, and disclosing the production of iron foil by electrodeposition.

Against this background, it is well to recall the basic requirements that have to be met for a satisfaction of the above mentioned needs and demands.

Briefly, care must be taken that the flexible printing plates are clamped tightly and uniformly on the cylinder body, and that the butt joint is closed completely so that no ink can be deposited therein and so that the wiper or doctor blade can slide smoothly over it, whereby no objectionable trace of the plate edges appear on the printed copy. In other words, the printing plates have to abutt each other in a gapless fashion, be individually replaceable or exchangeable, be positioned firmly on the form cylinder so as to avoid a lifting thereof during the printing process, and be maintained in their position on the form cylinder with high precision.

Against this background, I invented the form cylinder and flexible printing plate disclosed, for instance, in my U.S. Pat. No. 4,157,067 issued June 5, 1979 and incorporated herewith by reference herein.

My invention according to that patent employed clamping bar mechanisms for attaching wrap-on printing plates to form cylinders, and proposed several techniques for joining the printing plate body to the clamping bars, and for minimizing any gap between adjacent printing bars or between any printing bar and an adjacent printing cylinder surface.

While these proposals and their practical implementation represented a substantial advance in the art, there was still room for improvement in terms of attainable printing quality. Moreover, the manner of attachment of the clamping bar on the printing plate as disclosed in my prior patent is by its nature time-consuming and in need for frequent reworking and finishing.

SUMMARY OF THE INVENTION

It is a general object of this invention to overcome the disadvantages and meet the needs expressed or implicit in the above disclosure statement or in other parts hereof.

It is a germane object of this invention to provide improved methods and apparatus for producing wrap-on printing plates.

It is a related object of the invention to provide improved wrap-on printing plates in which the distance between clamping bars, that is the lengths of the printing plate, as well as their width, conform exactly to the required measurements.

It is a related object of the invention to provide improved wrap-on printing plates in which the connection between clamping bars and the printing plate body is seamless and immune to tension, pressure and flexure, as well as free of internal stresses and warping tendencies.

It is a related object of the invention to provide improved wrap-on printing plates in which the printing plate body and clamping bars are all in one piece interconnected by interatomic bonding.

It is a similar object of this invention to provide improved wrap-on printing plates which may be manufactured economically and without the need for extensive finishing, dressing and reworking.

It is a related object of this invention to provide improved wrap-on printing plates which dispense with a need for gap peeling of the type previously required with similar printing plates and which otherwise provide high print capability and quality without an objectionable trace of any gap at the wrap-on plate appearing on the printed material.

It is a further object of this invention to provide improved methods of producing wrap-on printing plates for installation on printing cylinders, and to produce wrap-on printing plates made by such methods.

Other objects of the invention will become apparent in the further course of this disclosure.

The subject invention resides in a method of producing a wrap-on printing plate with first and second clamping bars along opposite sides thereof for installation on a printing cylinder, and also resides in a wrap-on printing plate made by such method. The method according to this aspect comprises, in combination, the steps of providing a layer defining a printing plate body, forming from marginal portions of that layer, along opposite sides thereof, first and second foundations for the first and second clamping bars, respectively, providing the first and second clamping bars on the first and second foundations by interatomic bonding between the first and second foundations and the first and second clamping bars, respectively, and finishing the printing plate body and clamping bars.

Other aspects of the invention will be discussed or become apparent in the further course of this disclosure, and no limitation to any statutory class or classes or to any combination, feature or component, or to any aspect of the subject invention, is intended with this summary of the invention.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
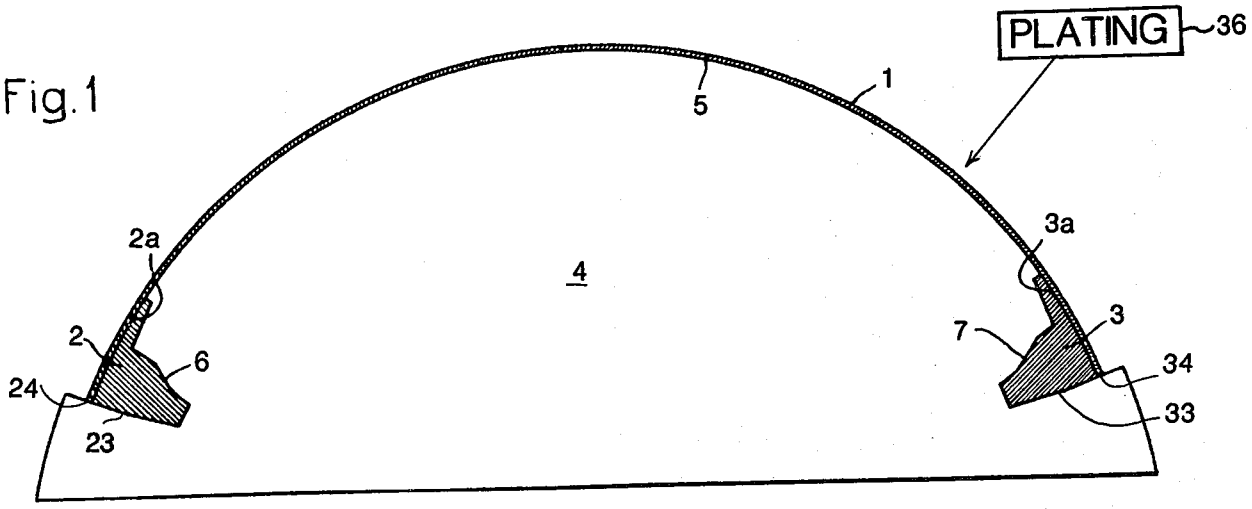
FIG. 1 is a cross-section through apparatus for producing a wrap-on printing plate according to a preferred embodiment of the subject invention.

FIG. 1 shows an apparatus for producing a wrap-on printing plate 1 for installation on a printing cylinder with the aid of first and second clamping bars 2 and 3 having, respectively, corresponding first and second top surfaces 2*a* and 3*a* thereon. The objects herein referred to as "printing plates" may actually be termed printing plate blanks, since no printing information is located thereon at the stages herein illustrated. Accordingly, the printing plates or blanks herein shown are provided in a conventional manner with the image and text information to be printed therefrom. For instance, in the case of intaglio or rotogravure type of printing, the wrap-on blank may be etched or engraved in a conventional manner.

The finished printing plate may then be wrapped or clamped on a form cylinder which, for instance, may be of the type shown in my above mentioned U.S. Pat. No. 4,157,067, incorporated by reference herein for its drawings and other disclosure parts, including particularly its FIGS. 1 to 4 and their accompanying text of the patent.

Figure 3:
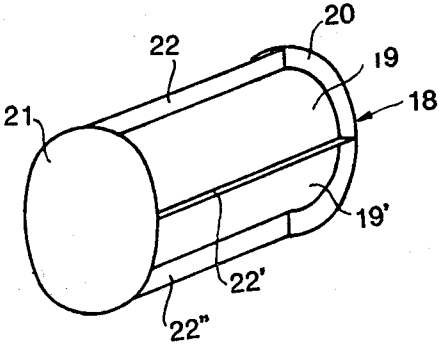
FIG. 3 is a perspective view of a form for the simultaneous production of several wrap-on printing plates.
Figure 2:
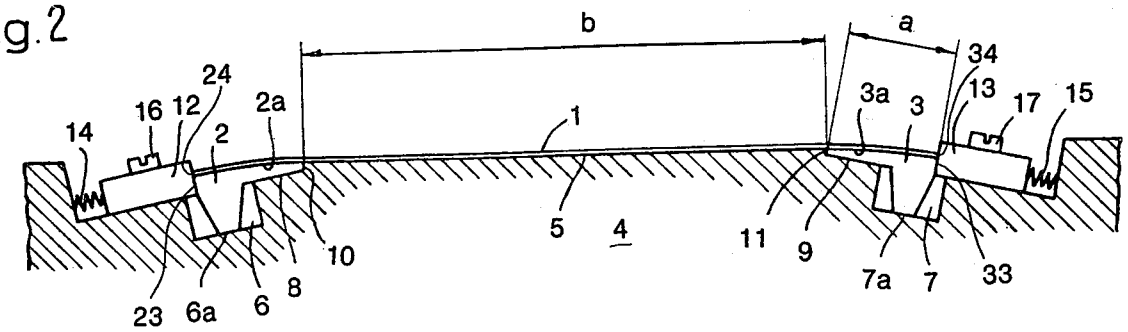
FIG. 2 is a cross-section through an apparatus for producing a wrap-on printing plate according to a further preferred embodiment of the subject invention.

The subject invention provides a plating form 4 having a form surface 5, included by way of example in the apparatus of FIGS. 1 and 2 and, as form 18 and form surfaces 19 and 19', in the apparatus of FIG. 3, for producing a wrap-on printing plate 1 for installation on a printing cylinder (see FIGS. 1 and 2 of my above mentioned U.S. Pat. No. 4,157,067) with the aid of first and second clamping bars 2 and 3 having, respectively, corresponding first and second top surfaces 2*a* and 3*a*.

In the embodiments of FIGS. 1 and 3, the plating forms 4 and 18 and the form surfaces 5, 19 and 19' are curved, while the corresponding form and form surface in the embodiment of FIG. 2 are essentially flat.

As seen in FIGS. 1 and 2, the first and second clamping bars 2 and 3 are releasably installed at opposite sides of the form surface 5. In this respect, the first clamping bar may be considered as being provided with a first edge 23 adapted to extend transversely or axially of a printing or form cylinder (such as cylinder 1 or 2, 2a in my U.S. Pat. No. 4,157,067) to define a first lateral extremity 24 of the printing plate or blank 1. Similarly, the second clamping bar 3 may be considered as being provided with a second edge 33 adapted to extend transversely or axially of the printing cylinder, when the printing plate is installed thereon, and to face away from the first edge 23 to define a second lateral extremity 34 of the printing plate. The expression "facing away" in this respect refers to an orientation of the second edge 33 relative to the first edge 23 as considered along the printing plate or blank 1 whereby the edge of the second clamping bar 3 may still "face away" from the edge of the first clamping bar 2 even when the printing plate or the form surface 5 between the clamping bars 2 and 3 extends over more than half the circumference of a form or printing cylinder.

Against this background, the first and second clamping bars 2 and 3 are releasably installed at opposite sides of the form surface 5 so that their first and second edges 23 and 33 face away from each other.

The clamping bars 2 and 3 are or correspond to the profiled pieces 11 and 11' in my above mentioned U.S. Pat. No. 4,157,067, while the edges 23 and 33 correspond to the sealing surfaces 33 and 33' shown therein.

The plating forms 4 shown in FIGS. 1 and 2 have grooves or slots 6 and 7 for receiving, respectively, the first and second clamping bars 2 and 3 therein. To this end, the grooves 6 and 7 extend along opposite sides of the form surface 5. In the embodiment of FIG. 1, the grooves 6 and 7 extend axially in the periphery of the cylindrical form 4. In the embodiment of FIG. 2, the grooves 6 and 7 extend parallel to each other along opposite sides of the form surface 5.

If desired, means in addition to the clamping bar retaining portions of the form 4 may be employed at the slots 6 and 7 for installing or releasably retaining the bars 2 and 3.

The illustrated apparatus provide or include means for positioning the clamping bars 2 and 3 for continuous transition of their first and second top surfaces 2*a* and 3*a* with the form surface 5, whereby a one-piece assembly of the first and second bars 2 and 3 is produced by plating metal continuously on the top surfaces 2*a* and 3*a* of the bars 2 and 3 and on the form surface 5 between such bars.

In its method aspect, the subject invention provides a continuous transition between the form surface 5 and adjacent surfaces, such as the surfaces 2*a* and 3*a*, of the clamping bars 2 and 3. In terms of the preferred embodiments of FIGS. 1 and 2, the first groove 6 and first clamping bar 2, and the second groove 7 and second clamping bar 3, respectively, mutually correspond or are coordinated in configuration for an establishment and maintenance of a continuous transition between the form surface 5 and adjacent surfaces of the clamping bars. In terms of the embodiment of FIG. 2, for instance, there thus is a continuous transition of the first and second top surfaces 2*a* and 3*a* of the clamping bars 2 and 3 with the form surface 5.

According to a preferred embodiment of the subject invention, the plating form 4 and clamping bars 2 and 3 are provided with corresponding surfaces for a continuous transition between the form surface 5 and the clamping bars. As shown in FIG. 2 by way of example, the plating form 5 is provided at the first and second grooves 6 and 7 with surfaces 6*a*, 8 and 7*a*, 9 for supporting the first and second clamping bars, respectively. Also by way of example, the supporting surfaces 6*a* and 7*a* may constitute the bottom of the grooves 6 and 7 on which the clamping bars 2 and 3 rest and, if desired, may slide laterally.

Also according to the preferred embodiment shown in FIG. 2, the surfaces 8 and 9 are formed as guiding surfaces at the first and second grooves 6 and 7, for guiding the first and second clamping bars 2 and 3 into position for a continuous transition between the form surface 5 and adjacent surfaces 2*a* and 3*a* of the clamping bars.

The plating form preferably is provided with stops 10 and 11 at the guiding surfaces 8 and 9 for a precise positioning of the first and second clamping bars 2 and 3 across the form surface 5.

According to a preferred embodiment of the subject invention, the clamping bars 2 and 3 are resiliently biased against the stops 10 and 11. In this respect and by way of example, the apparatus shown in FIG. 2 includes first and second positioning bars or strips 12 and 13 which are biased by springs 14 and 15 into engagement with the first and second clamping bars 2 and 3, thereby pushing the clamping bars toward each other into engagement with the stops 10 and 11. Set screws 16 and 17 may be provided for releasably retaining the movable strips 12 and 13 in a position in which the clamping bars 2 and 3 are securely held on the plating form 4. In a manner known per se, the screws 16 and 17 may have shafts extending through elongate slots (not shown) in the strips 12 and 13 and having ends threaded into the plating form 4. A plurality of screws 16 or 17 may be provided as either positioning strip.

The strips 12 and 13 and fasteners 16 and 17 thus operate as means for selectively arresting the first and second clamping bars 2 and 3 in position at the plating surface 5.

The printing plate or blank 1 is made by galvanic metal deposition or plating on the form surface 5 and the top or attachment surfaces 2*a* and 3*a* of the clamping bars 2 and 3. First, these clamping bars are put into the grooves 6 and 7 in the plating form 4.

With the aid of springs or similar means, such as eccentric devices, the clamping bars 2 and 3 are positioned in the manner already described above with reference to the illustrated preferred embodiments. The relative position of the clamping bars 2 and 3, including their spacing from each other, is thereby exactly fixed.

The form 4 with installed clamping bars 2 and 3 is now electrolyzed in a bath, as customary in the galvanoplastic or electroplating art. In this manner, a galvanic metal deposition takes place on top of the form surface 5, as well as on the attachment surfaces 2*a* and 3*a* of the clamping bars 2 and 3.

As more fully described below, metal for the printing plate or blank 1 is thus releasably plated onto the form surface 5 and firmly onto and over the first and second clamping bars 2 and 3 from the first edge 23 of the first clamping bar to the second edge 33 of the second clamping bar. The electroplating process may be conducted or extended until a wrap-on printing plate, body or blank has been formed in which the first and second clamping bars 2 and 3 are in a one-piece assembly with a layer of the plated metal for a gap-less installation on a printing or form cylinder at the first and second lateral extremities 24 and 34. In FIG. 1, a block 36 symbolizes the entire plating procedure with all its necessary or desired steps. While not shown in such manner in the other drawings, the plating procedure useful with respect to the apparatus of FIG. 1 may also be practised with the apparatus of FIGS. 2 and 3.

In the preferred illustrated embodiment of the invention, the clamping bars 2 and 3 are positioned for continuous transition of their first and second top surfaces 2*a* and 3*a* with the form surface 5, whereby a one-piece assembly of the first and second bars with the printing plate body or blank is produced by plating metal continuously on the top surfaces 2*a* and 3*a* of the bars and on the form surface 5 between such clamping bars.

After the printing plate or blank has thus been formed, the same is removed together with the clamping bars 2 and 3 undetachably affixed thereto.

The dimensions of the printing plate or blank 1 and the mutual spacing of the clamping bar 6 and 7 of the formed one-piece assembly have thereby exactly the desired values, so that the further working of the printing plate blank for the achievement of desired dimensions is no longer necessary in the practice of the subject invention. The length of the printing plate or blank 1 is equal to the dimension b plus twice the dimension a indicated in FIG. 2. Between the clamping bars 2 and 3 and the printing plate body or blank 1, an undetachable, gap-free connection is obtained, which is mechanically sound under heavy loads and which is free of internal stresses and warping tendency. The objects of the subject invention are thus met.

The printing plate body or blank may be made or consists of one or more metal layers. For instance, a base layer of nickel may first be formed and may, for instance, have a thickness of 0.15 to 0.3 mm. Onto this base layer, a copper layer may subsequently be deposited and may, for instance, have a thickness of 0.15 mm or more. The use of nickel for the base layer is not mandatory, but provides the advantages of nickel, including a favorable modulus of elasticity and freedom from corrosion. Metals having similar properties may be used for the base layer instead of nickel. It is also possible to make printing plate blanks entirely of copper.

By using the plating methods herein described, it is also possible to re-copper already used printing plates. Also, after provision with the desired pictorial information or text, the printing plate 1 may be chrome-plated prior to its installation on the form cylinder.

The plating form may, in a manner known per se, be of a consumable or permanent nature. For instance, a permanent form may be made of steel, brass, nickel, stainless steel or another durable material. A consumable form 4 on the other hand, may be manufactured of easily meltable or dissolvable metals or plastic materials.

The form at its surface 5 does, of course, have to be electrically conducting. In the case of electrically non-conductive materials, the requisite electrical conductivity may be provided with the aid of a thin layer of graphite, silver, conductive lacquer or the like.

If the form 4 is of a non-disposable type, the printing plate blank has to be easily removable from the form surface 5. This may require the application of a separating solution to, or a suitable chemical treatment of, the form 4, with a reservation of a certain electrical conductivity at the form surface 5.

The latter step may be avoided by the use of a chrome-nickel steel form in the following manner:

Prior to the electrodeposition process, the form 4 and clamping bars 2 and 3 installed in the grooves 6 and 7 are electrolytically degreased and their form 4 is poled as the anode prior to termination of the degreasing process. In this manner, an oxidation of the chrome-nickel atoms takes place, whereby the form 4 is rendered electrochemically passive. Simultaneously, the clamping bars 2 and 3 are activated. They suitably may be made of steel for this purpose. The form 4 thus has good separation properties, while the electroplated metal attaches well to the clamping bars 2 and 3.

As already indicated, the clamping bars 2 and 3 are preferably made of steel. They may, however, consist of another suitable metallic or non-metallic material, including, for instance, synthetics. If the material of the clamping bars 2 and 3 is not electrically conductive, then at least the attachment surfaces 2*a* and 3*a* have to be rendered electrically conductive through suitable treatment in a manner known per se.

The plating form may be provided with more than only one form surface 5, whereby a simultaneous manufacture of several printing plate blanks is enabled. In this respect, FIG. 3 shows a plating form 18 with four form surfaces 19, 19', etc., which are arranged on the periphery or distributed over the circumference of the cylindrical form 18. At the edge of each form surface 19, 19', etc. there are grooves (not shown) similar to the grooves 6 and 7 shown in FIGS. 1 and 2, for receiving clampling bars of the types of bars 2 and 3 shown in FIGS. 1 and 2. The individual form surfaces 19, 19', etc. are delimited by lateral termination walls 20 and 21, and axially extending separation walls 22, 22', 22'', etc.

The formation of metal deposits on each form surface 19, 19', etc. and on the clamping bars associated therewith, is preferably effected in the manner already described with reference to FIGS. 1 and 2. Even though the manufacture of flexible printing plate blanks for the use in rotary intaglio printing has been emphasized herein, it should be understood that the methods and apparatus of the subject invention extend also to the manufacture of printing plates or blanks for other printing processes.

The utility of the subject invention also extends to the manufacture of screen printing forms or plates. In that case, the form surface 5 is provided with a pattern of non-conductive domains, whereby the requisite apertures of the screen printing form result.

Figure 5:
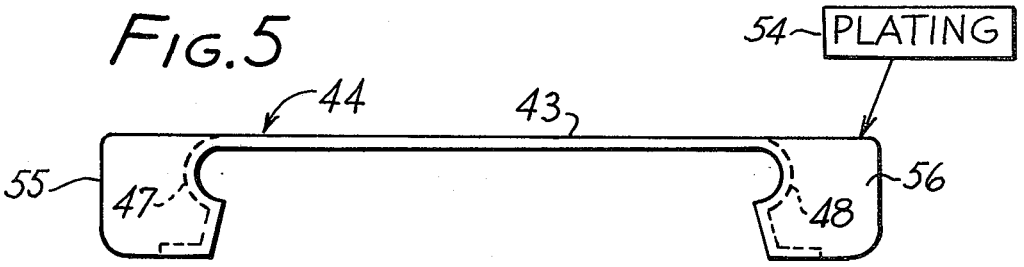
FIGS. 5 to 7 are side views of an evolutionary printing plate blank made with the apparatus of FIG. 4, and includes an illustration of further method steps in making a printing plate according to a preferred embodiment of the subject invention.
Figure 6:
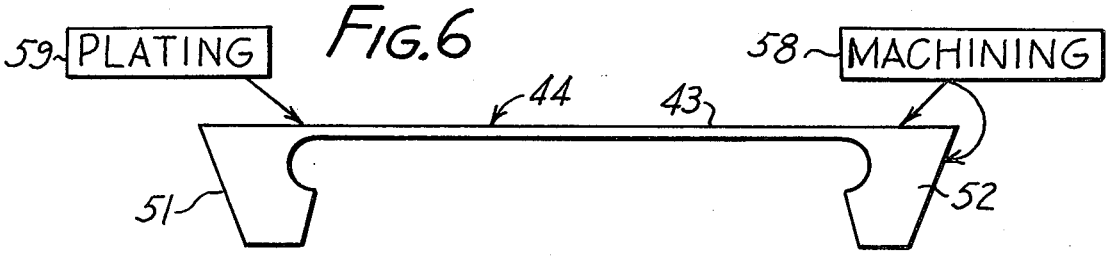

If desired, the clamping bars 2 and 3 may be provided with lateral recesses, such as the recesses 12 shown in FIGS. 5 and 6 of my above mentioned U.S. Pat. No. 4,157,067, for engagement by the pawls of the toggle mechanisms shown therein.

The embodiment or aspect of the invention disclosed herein with the aid of FIGS. 4 to 7 is presently considered the best mode of carrying out the subject invention. In fact, the embodiment or aspect of the invention is disclosed with the aid of FIGS. 4 to 7 is believed to be vastly superior to the embodiments described above with the aid of FIGS. 1 and 2, at least in terms of overall economy of manufacture and quality of the resulting product. Nevertheless, the aspects or embodiments of the invention shown in FIGS. 1 to 7 are part of generic method, article and apparatus combinations, as will be more fully shown below.

Figure 4:
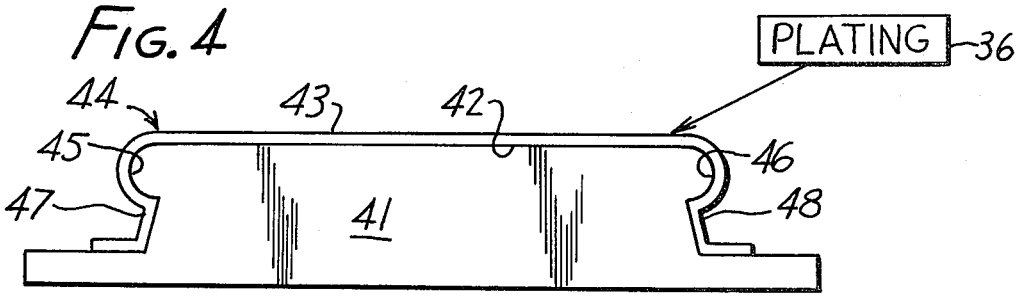
FIG. 4 is a side view of apparatus for producing a wrap-on printing plate according to another aspect of the subject invention.

As seen in FIG. 4, the invention thereby disclosed provides a form 41 having a first surface 42 for a formation of a layer 43 defining a printing plate body 44. The invention provides on the form 41, along opposite sides of the surface 42, first and second configurations 45 and 46 for a formation of first and second foundations 47 and 48 for first and second clamping bars 51 and 52, respectively.

The invention then coats the form 41 on its first surface 42 and on the first and second configurations 45 and 46 with a one-piece layer 43 defining the foundations 47 and 48 for the first and second clamping bars 51 and 52, respectively, and a printing plate body 44 extending between such foundations.

By way of example, and as indicated by the block 36 in FIG. 4, the one-piece layer 43 with extensions 47 and 48 may be formed by plating material on the form 41. For instance, a layer 43 of nickel may be electroplated on the form 41 in the configuration shown in FIG. 4.

In this respect, the same form materials and electroplating processes may be employed as disclosed above with respect to FIGS. 1 to 3. In this respect, the form 41 has been shown as relatively flat or planar in FIG. 4. It should, however, be understood that the form 41 may be curved in a manner shown in FIG. 1, FIG. 3 or otherwise. Also, while the form 41 has been shown in front elevation in FIG. 4, it should be understood that the lateral configurations 45 and 46 may be complementary and parallel to each other throughout the depth of the form 41. These configurations may, for instance, be formed by machining the thick plate of which the form 41 is made. Alternatively, the form 41 may be cast or molded into its configuration apparent from FIG. 4.

FIG. 4 thus presents an apparatus for producing a wrap-on printing plate for installation on a printing cylinder and, more specifically, illustrates the improvement comprising, in combination, a form 41 having a first surface 42 for a formation of a layer 43 defining a printing plate body, and first and second configurations 45 and 46, along opposite sides of the surface 42, for a formation of first and second foundations 47 and 48 for first and second clamping bars 51 and 52, respectively. FIG. 4 also represents means 36 for coating the form 41 on the first surface 42 and on the first and second configurations 45 and 46 with a one-piece layer 43 defining the foundations 47 and 48 for first and second clamping bars 51 and 52, respectively, and a printing plate body 44 extending between such foundations.

As seen in FIG. 4, the first and second configurations 45 and 46, and thereby the first and second foundations 47 and 48, are angled relative to the first surface 42 or top printing plate body 44. According to a preferred embodiment of the subject invention, the first and second configurations 45 and 46, and thereby the first and second foundations 47 and 48, are shaped as countours of the first and second clamping bars 51 and 52, respectively. Depending on the configuration and operation of the pawls or other means for retaining the clamping bars on a printing cylinder, the first and second configurations 45 and 46, and thereby the first and second foundations 47 and 48, may be shaped in the form of inverted arabic figures five.

The preferred embodiment or aspect of the invention shown in FIGS. 4 to 7 forms on the first and second foundations 47 and 48 first and second clamping bars, respectively, for installation of the wrap-on printing plate on a printing cylinder. As seen in FIG. 4, the one-piece layer 43, including the lateral foundations 47 and 48, may be removed from the form 41 for this purpose.

As also seen in FIG. 5, the formation of the first and second clamping bars 51 and 52 may include deposition of material on, and in one piece with, the first and second foundations 47 and 48.

As indicated in FIG 5 at 54, electroplating or similar material deposition may be employed for this purpose. For example, immersion plating involving a deposition of thick metallic coatings on the foundations 47 and 48 by chemical replacement from a solution of a salt of the coating material may be employed. Large deposits of copper may, for instance, be thus formed on nickel foundations 47 and 48.

No limitation to any particular plating technique is intended herein. In this respect, it may be said that the deposition of metals from ionic solutions comprises the step of adding electrons to dissolved metal ions. In electroplating, electrons are supplied from an external source. In immersion plating, electrons are provided by the basis metal as it dissolves in the bath. In autocatalytic or electroless plating, electrons are furnished by chemical reducing agents included in the bath formulation. Any or all three of these techniques may be employed in the practice of the subject invention, as long as they produce a deposit of sufficient strength and quality for the particular step or purpose.

The illustrated preferred embodiment of the invention thus provides material for a formation of the first and second clamping bars 51 and 52 on the first and second foundations 47 and 48. Individual particles of such material are deposited on the first and second foundations 47 and 48, such as indicated at 54 in FIG. 5, by bonding first particles of such material individually to the first foundation 47 and to each other, bonding second particles of the material to such bonded first particles and to each other until a sufficient first body of material 55 for a formation of the first clamping bar 51 in one piece with the first foundation 47 and printing plate body 44 has been deposited, bonding third particles of the material indivdiually to the second foundation 48 and to each other, and bonding fourth particles of the material to such bonded first particles and to each other until a sufficient second body of material 56, as seen in FIG. 5, for a formation of the second clamping bar 52 in one piece with the second foundation 48 and printing plate body 44 has been deposited.

According to a preferred embodiment thereof, the invention provides a layer 43 defining a printing plate body 44, and forms from marginal portions of such layer, along opposite sides thereof, first and second foundations 47 and 48 for first and second clamping bars 51 and 52, respectively.

As illustrated in FIG. 5, the preferred embodiment of the invention then electrochemically plates first and second bodies of materials 55 and 56 on the first and second foundations 47 and 48, respectively, thereby uniting such first and second bodies 55 and 56 by atomic bonding with the first and second foundations 47 and 48, respectively, in one piece including the printing plate body 44. Due to such interatomic or particle bonding, the resulting printing plate structure displays a strength, rigidity and precision not achievable by a conventional attachment of manufactured clamping bars to the printing plate body.

The illustrated preferred embodiment of the subject invention according to FIG. 6 then forms on the first and second foundations 47 and 48 from the first and second bodies 55 and 56 and foundations 47 and 48, respectively, the first and second clamping bars 51 and 52, for installation of the wrap-on printing plate on a printing cylinder. As shown at 58 in FIG. 6, machining or milling may be employed for this purpose.

As indicated at 59 in FIG. 6, further copper or other suitable plating may be applied to the printing plate body and machined clamping bars until the entire printing plate blank has all exact dimensions, including accurate length and width.

According to a preferred embodiment of the invention, the final plating step or process advantageously takes place in a form according to FIG. 1 or preferably according to FIG. 2, wherein highest plating precision may be achieved.

The plating 59 may be viewed as part of a finished operation of the printing plate body 44 and clamping bars 51 and 52. At any rate, a final finishing operation is indicated at 61 in FIG. 7, and includes working of the printing plate surface to achieve the most accurate required printing plate thickness and an optimum surface quality. Fine polishing machinery may be employed for this purpose.

Figure 7:
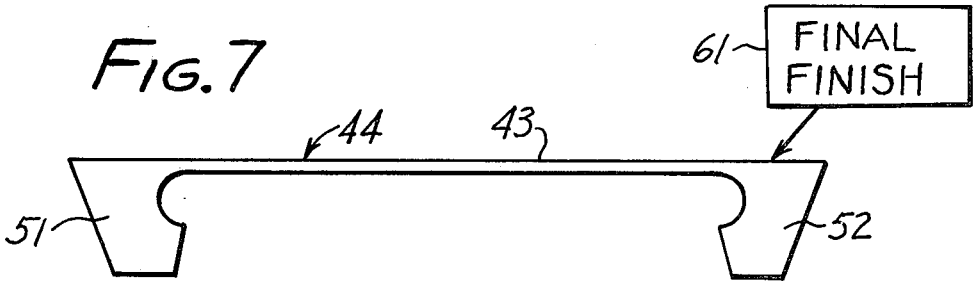

The finished printing plate blank according to FIG. 7, herein sometimes briefly referred to as "printing plate," may then be provided in a conventional manner with the image and text information to be printed therefrom. As already indicated above, the wrap-on blank may be etched or engraved in the case of intaglio or rotogravure type of printing. Alternatively screen printing forms or plates may be manufactured, such as by providing on the form surface 42 a pattern of non-conductive domains, whereby the requisite apertures of the screen printing form result, as mentioned above.

The embodiments or aspects of the subject invention according to FIGS. 1 to 3 and 4 to 7 may be seen as part of a generic concept, method, article and apparatus.

In particular, it is noted that both types of embodiments provide a layer 1 or 43 defining a printing plate body. Also, both types of embodiments form from marginal portions of such layer, along opposite sides thereof, first and second foundations for the first and second clamping bars 2 and 3 or 51 and 52, respectively. In the case of the embodiment shown in FIGS. 1 and 2, the foundation for the clamping bars 2 and 3 coincide with the areas 2*a* and 3*a* at which such clamping bars are attached to the layer 1 by plating of the layer on the clamping bars 2 and 3. In the embodiment of FIGS. 4 to 7, the first and second foundations 47 and 48 for the clamping bars 51 and 52 are clearly seen as being formed from marginal portions of the layer 43 to extend along opposite sides of the printing plate body 44.

Also, in both types of embodiments the first and second clamping bars 2 and 3 or 51 and 52 are provided on the first and second foundations at 2*a* or 3*a* or 47 and 48 by interatomic bonding between such first and second foundations and first and second clamping bars, respectively. By way of example, the embodiments of FIGS. 1 and 2 electroplate the layer 1 onto the bars 2 and 3 for this purpose, while the embodiment of FIG. 5 plates the first and second clamping bar bodies 55 and 56 onto the foundations 47 and 48 in such a manner that these foundations 47 and 48 practically lose their separate identity and become part of one-piece clamping bar bodies, as indicated by dotted lines at 47 and 48 at FIG. 5.

If desired, the interatomic bonding requirement of this generic concept, or of the embodiment of FIGS. 4 and 5 may also be accomplished by methods other than electroplating. For instance, the printing plates with attached one-piece clamping bars may be manufactured from plastic materials employing interatomic or intermolecular bonding, even though electrochemical plating is presently preferred for a currently superior workability and higher achievable precision.

Other extensions, variations and modifications within the spirit and scope of the subject invention will be apparent to those skilled in the art from the subject extensive disclosure itself or in conjunction with my above mentioned U.S. Pat. No. 4,157,067, herewith incorporated by reference herein.

I claim:

1. In a method of producing a wrap-on printing plate with first and second clamping bars along opposite sides thereof for installation on a printing cylinder, the improvement comprising in combination the steps of:

providing a layer defining a printing plate body;

forming from marginal portions of said layer, along opposite sides thereof, first and second foundations for said first and second clamping bars, respectively;

providing said first and second clamping bars on said first and second foundations by interatomic bonding between said first and second foundations and said first and second clamping bars, respectively; and finishing said printing plate body and clamping bars.

2. A method as claimed in claim 1, including the step of:

angling said marginal portions of said layer relative to said printing plate body.

3. A method as claimed in claim 1, including the step of:

shaping said marginal portions of said layer as contours of said first and second clamping bars, respectively.

4. In a method of producing a wrap-on printing plate for installation on a printing cylinder, the improvement comprising in combination the steps of:

providing a layer defining a printing plate body;

forming from marginal portions of said layer, along opposite sides thereof, first and second foundations for first and second clamping bars, respectively;

providing material for a formation of said first and second clamping bars on said first and second foundations, respectively, for installation of the wrap-on printing plate on a printing cylinder;

depositing individual particles of said material on said first and second foundations by bonding first particles of said material individually to said first foundation and to each other, bonding second particles of said material to said bonded first particles and to each other until a sufficient first body of material for a formation of that first clamping bar in one piece with said first foundation and printing plate body has been deposited, bonding third particles of said material individually to said second foundation and to each other, and bonding fourth particles of said material to said bonded third particles and to each other until a sufficient second body of material for a formation of said second clamping bar in one piece with said second foundation and printing plate body has been deposited; and finishing said printing plate body and said clamping bars from said first and second bodies of material all in one continuous piece.

5. A method as claimed in claim 4, including the step of:

angling said marginal portions of said layer relative to said printing plate body.

6. A method as claimed in claim 4, including the step of:

shaping said marginal portions of said layer as contours of said first and second clamping bars, respectively.

7. A method as claimed in claim 4, including the step of:

shaping said marginal portions of said layer in the form of inverted arabic figures five.

8. A method as claimed in claim 4, 5, 6, or 7, wherein:

said forming of said first and second clamping bars includes machining said first and second bodies.

9. In a method of producing a wrap-on printing plate for installation on a printing cylinder, the improvement comprising in combination the steps of:

providing a layer defining a printing plate body;

forming from marginal portions of said layer, along opposite sides thereof, first and second foundations for first and second clamping bars, respectively;

electrochemically plating first and second bodies of material on said first and second foundations, respectively, thereby uniting said first and second bodies by atomic bonding with said first and second foundations, respectively, in one piece including said printing plate body;

forming on said first and second foundations from said first and second bodies and foundations, respectively, said first and second clamping bars for installation of the wrap-on printing plate on a printing cylinder; and finishing said printing plate body and clamping bars.

10. A method as claimed in claim 9, including the step of:

angling said marginal portions of said layer relative to said printing plate body.

11. A method as claimed in claim 9, including the step of:

shaping said marginal portions of said layer as contours of said first and second clamping bars, respectively.

12. A method as claimed in claim 9, including the step of:

shaping said marginal portions of said layer in the form of inverted arabic figures five.

13. In a method of producing a wrap-on printing plate for installation on a printing cylinder, the improvement comprising in combination the steps of:

providing a form having a first surface for a formation of a layer defining a printing plate body;

providing on said form, along opposite sides of said surface, first and second configurations for a formation of first and second foundations for first and second clamping bars, respectively;

coating said form on said first surface and on said first and second configurations with a one-piece layer defining said foundations for first and second clamping bars, respectively, and a printing plate body extending between said foundations;

forming on said first and second foundations first and second clamping bars, respectively, for installation of the wrap-on printing plate on a printing cylinder; and finishing said printing plate body and clamping bars.

14. A method as claimed in claim 13, including the step of:

angling said first and second configurations relative to said first surface.

15. A method as claimed in claim 13, including the step of:

shaping said first and second configurations as contours of said first and second clamping bars, respectively.

16. A method as claimed in claim 13, including the step of:

shaping said first and second configurations in the form of inverted arabic figures five.

17. A method as claimed in claim 13, 14, 15 or 16, wherein:

said forming of said first and second clamping bars includes deposition of material on, and in one piece with, said first and second foundations.

18. A method as claimed in claim 17, wherein:

said forming of said first and second clamping bars includes machining said deposition of material.

19. In a method of producing a wrap-on printing plate for installation on a printing cylinder, comprising in combination the steps of:

providing first and second clamping bars for a releasable attachment of the printing plate to the printing cylinder;

providing said first clamping bar with a first edge adapted to extend transversely of the printing cylinder to define a first lateral extremity of the printing plate;

providing said second clamping bar with a second edge adapted to extend transversely of the printing cylinder and to face away from said first edge to define a second lateral extremity of the printing plate;

providing a plating form having a form surface;

releasably installing said first and second clamping bars at opposite sides of said form surface so that said first and second edges face away from each other; and plating metal for said printing plate releasably onto said form surface and firmly onto and over said first and second clamping bars from said first edge of said first clamping bar to said second edge of said second clamping bar until a wrap-on printing plate body has been formed in which said first and second clamping bars are in a one-piece assembly with a layer of the plated metal for a gap-less installation at said first and second lateral extremities.

20. A method as claimed in claim 19, including the step of:

curving said form surface.

21. A method as claimed in claim 19, including the step of:

making said form surface flat.

22. A method as claimed in claim 19, including the step of:

providing for a continuous transition between said form surface and adjacent surfaces of said clamping bars.

23. A method as claimed in claim 19, including the step of:

providing said plating form and clamping bars with corresponding surfaces for a continuous transition between said form surface and said clamping bars.

24. A method as claimed in claim 19, including the step of:

providing said plating forms with stops for an exact spacing of said first and second clamping bars across said form surface.

25. A method as claimed in claim 19, including the steps of:

providing said plating form with first and second grooves on opposite sides of said plating surface; and releasably installing said first and second clamping bars in said first and second grooves, respectively.

26. A method as claimed in claim 25, including the step of:

coordinating said first groove and first clamping bar and said second groove and second clamping bar, respectively, for an establishment and maintenance of a continuous transition between said form surface and adjacent surfaces of said clamping bars.

27. A method as claimed in claim 25, including the step of:

providing said plating form with surfaces at said first and second grooves for supporting said first and second clamping bars.

28. A method as claimed in claim 25, including the step of:

providing said plating form with guiding surfaces at said first and said second grooves for guiding said first and second clamping bars into position for a continuous transition of said form surface and adjacent surfaces of said clamping bars.

29. A method as claimed in claim 25, including the steps of:

providing said plating form with guiding surfaces at said first and second grooves for guiding said first and second clamping bars toward said form surface; and providing said plating form with stops at said guiding surfaces for a precise positioning of said first and second clamping bars across said form surface.

30. A method as claimed in claim 24 or 29, including the step of:

resiliently biasing said first and second clamping bars against said stops.

31. A method as claimed in claim 30, including the step of:

selectively arresting said first and second clamping bars at said plating surface.

32. A wrap-on printing plate with first and second clamping bars along opposite sides thereof for installation on a printing cylinder, produced by a method comprising in combination the steps of:

providing a layer defining a printing plate body;

forming from marginal portions of said layer, along opposite sides thereof, first and second foundations for said first and second clamping bars, respectively;

providing said first and second clamping bars on said first and second foundations by interatomic bonding between said first and second foundations and said first and second clamping bars, respectively; and finishing said printing plate body and clamping bars.

33. A printing plate as claimed in claim 32, wherein:

said marginal portions of said layer are angeled relative to said printing plate body.

34. A printing plate as claimed in claim 32, wherein:

said marginal portions of said layer are shaped as contours of said first and second clamping bars respectively.

35. A wrap-on printing plate for installation on a printing cylinder, produced by a method comprising in combination the steps of:

providing a layer defining a printing plate body;

forming from marginal portions of said layer, along opposite sides thereof, first and second foundations for first and second clamping bars, respectively;

providing material for a formation of said first and second clamping bars on said first and second foundations, respectively, for installation of the wrap-on printing plate on a printing cylinder;

depositing individual particles of said material on said first and second foundations by bonding first particles of said material individually to said first foundation and to each other, bonding second particles of said material to said bonded first particles and to each other until a sufficient first body of material for a formation of that first clamping bar in one piece with said first foundation and printing plate body has been deposited, bonding third particles of said material individually to said second foundation and to each other, and bonding fourth particles of said material to said bonded third particles and to each other until a sufficient second body of material for a formation of said clamping bar in one piece with said first foundation and printing plate body has been deposited; and finishing said printing plate body and said clamping bars from said first and second bodies of material all in one continuous piece.

36. A printing plate as claimed in claim 35, wherein:

said marginal portions of said layer are angled relative to said printing plate body.

37. A printing plate as claimed in claim 35, wherein:

said marginal portions of said layer are shaped as contours of said first and second clamping bars, respectively.

38. A printing plate as claimed in claim 35, wherein:

said marginal portions of said layer are shaped in the form of inverted arabic figures five.

39. A printing plate as claimed in claim 35, 36, 37 or 38, wherein:

said forming of said first and second clamping bars includes machining said first and second bodies.

40. A wrap-on printing plate for installation on a printing cylinder, produced by a method comprising in combination the steps of:

providing a layer defining a printing plate body;

forming from marginal portions of said layer, along opposite sides thereof, first and second foundations for first and second clamping bars, respectively;

electrochemically plating first and second bodies of material on said first and second foundations, respectively, thereby uniting said first and second bodies by atomic bonding with said first and second foundations, respectively, in one piece including said printing plate body;

forming on said first and second foundations from said first and second bodies and foundations, respectively, said first and second clamping bars for installation of the wrap-on printing plate on a printing cylinder; and finishing said printing plate body and clamping bars.

41. A printing plate as claimed in claim 40, wherein:

said marginal portions of said layer are angled relative to said printing plate body.

42. A printing plate as claimed in claim 40, wherein:

said marginal portions of said layer are angled as contours of said first and second clamping bars, respectively.

43. A printing plate as claimed in claim 40, wherein:

said marginal portions of said layer are shaped in the form of inverted arabic figures five.

44. A wrap-on printing plate for installation on a printing cylinder, produced by a method comprising in combination the steps of:

providing a form having a first surface for a formation of a layer defining a printing plate body;

providing on said form, along opposite sides of said surface, first and second configurations for a formation of first and second foundations for first and second clamping bars, respectively;

coating said form on said first surface and on said first and second configurations with a one-piece layer defining said foundations for first and second clamping bars, respectively, and a printing plate body extending between said foundations;

forming on said first and second foundations first and second clamping bars, respectively, for installation of the wrap-on printing plate on a printing cylinder; and finishing said printing plate body and clamping bars.

45. A printing plate as claimed in claim 44, wherein:

said first and second configurations are angled relative to said first surface.

46. A printing plate as claimed in claim 44, wherein:

said marginal portions of said layer are shaped as contours of said first and second clamping bars, respectively.

47. A printing plate as claimed in claim 44, wherein: said marginal portions of said layer are shaped in the form of inverted arabic figures five.

48. A printing plate as claimed in claim 44, 45, 46 or 47 wherein:

said forming of said first and second clampbars includes deposition of material on, and in one piece with, said first and second foundations.

49. A printing plate as claimed in claim 48, wherein: said forming of said first and second clamping bars includes machining said deposition of material.

50. A wrap-on printing plate for installation on a printing cylinder, produced by a method comprising in combination the steps of:

providing first and second clamping bars for a releasable attachment of the printing plate to the printing cylinder;

providing said first clamping bar with a first edge adapted to extend transversely of the printing cylinder to define a first lateral extremity of the printing plate;

providing said second clamping bar with a second edge adapted to extend transversely of the printing cylinder and to face away from said first edge to define a second lateral extremity of the printing plate;

providing a plating form having a form surface;

releasably installing said first and second clamping bars at opposite sides of said form surface so that said first and second edges face away from each other; and plating metal for said printing plate releasably onto said form surface and firmly onto and over said first and second clamping bars from said first edge of said first clamping bar to said second edge of said second clamping bar until a wrap-on printing plate body has been formed in which said first and second clamping bars are in a one-piece assembly with a layer of the plated metal for a gap-less installation at said first and second lateral extremities.

51. A printing plate as claimed in claim 50, wherein: said form surface is curved.

52. A printing plate as claimed in claim 50, wherein: said form surface is flat.

53. A printing plate as claimed in claim 50, including: a continuous transition between said form surface and adjacent surfaces of said clamping bars.

54. A printing plate as claimed in claim 50, wherein: said plating form and clamping bars have corresponding surfaces for a continuous transition between said form surface and said clamping bars.

55. A printing plate as claimed in claim 50, wherein: said plating form has stops for an exact spacing of said first and second clamping bars across said form surface.

56. A printing plate as claimed in claim 50, wherein: said plating form has first and second grooves on opposite sides of said plating surface; and said first and second clamping bars are releasably installed in said first and second grooves, respectively.

57. A printing plate as claimed in claim 50, wherein: said first groove and first clamping bar and said second groove and second clamping bar, respectively, are coordinated for an establishment and maintenance of a continuous transition between said form surface and adjacent surfaces of said clamping bars.

58. A printing plate as claimed in claim 50, wherein: said plating form has surfaces at said first and second grooves for supporting said first and second clamping bars.

59. A printing plate as claimed in claim 50, wherein: said plating form has guiding surfaces at said first and said second grooves for guiding said first and second clamping bars into position for a continuous transition of said form surface and adjacent surfaces of said clamping bars.

60. A printing plate as claimed in claim 56, wherein: said plating form has guiding surfaces at said first and second grooves for guiding said first and second clamping bars toward said form surface; and said plating form has stops at said guiding surfaces for a precise positioning of said first and second clamping bars across said form surface.

61. A printing plate as claimed in claim 55 or 60, wherein:

said first and second clamping bars are biased against said stops.

62. A printing plate as claimed in claim 61, wherein: said first and second clamping bars are selectively arrested at said plating surface.

* * * * *